US008162239B2

(12) United States Patent
Hursen

(10) Patent No.: US 8,162,239 B2
(45) Date of Patent: Apr. 24, 2012

(54) AIR GUN SAFETY NOZZLE

(76) Inventor: Thomas Francis Hursen, Allison Park, PA (US)

( * ) Notice: Subject to any disclaimer, the term of this patent is extended or adjusted under 35 U.S.C. 154(b) by 548 days.

(21) Appl. No.: 12/124,775

(22) Filed: May 21, 2008

(65) Prior Publication Data

US 2008/0290193 A1 Nov. 27, 2008

Related U.S. Application Data

(60) Provisional application No. 60/930,972, filed on May 21, 2007.

(51) Int. Cl.
*B05B 1/30* (2006.01)
*B05B 7/02* (2006.01)
*B05B 1/26* (2006.01)

(52) U.S. Cl. ..... 239/571; 239/526; 239/518

(58) Field of Classification Search ..... 239/570, 239/571, 572, 579, 586, 290, 291, 498, 526, 239/295, 525, 299, 518, 597; 222/59
See application file for complete search history.

(56) References Cited

U.S. PATENT DOCUMENTS 2,148,335 A * 2/1939 Arola ..... 222/442
3,599,876 A 8/1971 Kyburg
3,647,142 A 3/1972 Drude et al.
3,672,575 A 6/1972 Hinrichs
3,743,186 A 7/1973 Mocarski
3,774,847 A 11/1973 Malec
3,790,084 A * 2/1974 Kinsley ..... 239/291
3,790,085 A * 2/1974 Ayer ..... 239/291
3,814,329 A 6/1974 Clark
3,888,422 A 6/1975 Robinson
3,963,180 A 6/1976 Wagner
3,980,238 A * 9/1976 Adiletta ..... 239/590.3
4,025,045 A 5/1977 Kubiak
4,026,474 A 5/1977 Knauer et al.
4,036,438 A 7/1977 Soderlind et al.
4,038,786 A 8/1977 Fong
4,091,999 A * 5/1978 Voos ..... 239/289
4,243,178 A 1/1981 Self
4,677,958 A 7/1987 Gayler
4,721,249 A 1/1988 Lassiter
4,813,611 A 3/1989 Fontana
4,872,802 A * 10/1989 Abbe ..... 414/416.09
4,905,481 A 3/1990 Scaringe
5,119,744 A 6/1992 Comer
5,135,167 A 8/1992 Ringer
5,167,878 A 12/1992 Arbisi et al.
5,170,943 A 12/1992 Artzberger
5,212,891 A 5/1993 Schuermann et al.
5,285,965 A 2/1994 McCutcheon et al.
5,531,590 A 7/1996 Browning
5,558,463 A 9/1996 Geisel
5,681,132 A 10/1997 Sheppard, Jr.
5,713,212 A 2/1998 Barnett et al.
5,782,414 A 7/1998 Nathenson
6,811,812 B2 11/2004 Van Steenkiste
6,868,830 B1 3/2005 Meyer et al.
6,983,587 B2 1/2006 Shumate

* cited by examiner

*Primary Examiner* — Len Tran
*Assistant Examiner* — Justin Jonaitis
(74) *Attorney, Agent, or Firm* — Blynn L. Shideler; Krisanne Shideler; BLK Law Group

(57) ABSTRACT

A nozzle that produces an outlet velocity air, or other fluid jet, is provided with safety passages which achieve the safety requirement of automatically reducing the local exit pressure "dead end" limit to 30 psig or less when the nozzle outlet is partially or completely obstructed. The safety passages do not reduce the effectiveness of the normal function of the air, or other fluid, jet through the provision of a check valve to block undesirable reverse flow in the safety passage(s) thus avoiding ambient fluid flow to the nozzle exit that degrades the nozzle's normal operating air, or other fluid, jet. This is especially useful for supersonic air gun nozzles which have been adapted to digging in the ground, and other purposes, but it is also useful for sonic and subsonic nozzles that are used for other purposes such as cleaning, and other applications.

20 Claims, 9 Drawing Sheets

2
1
3
4
5
7

6
9
8

A
A
10
11
12

17
11
SECTION AA
11

10

2
1
13

5
3
4
7
25
6
9
24
18

A
A
19
8
11
12
SECTION BB
21
23
B
11
B

18
SECTION AA

SECTION BB

SECTION AA

AIR GUN SAFETY NOZZLE

CROSS REFERENCE TO RELATED APPLICATIONS

The present application claims the benefit of U.S. provisional patent application Ser. No. 60/930,972, entitled "Safety Nozzle", filed May 21, 2007.

BACKGROUND OF THE INVENTION

1. Field of the Invention

This invention relates generally to safety nozzles employing fluids, more specifically to supersonic nozzles for air guns that may be used for digging in dirt and similar substances, and/or for sonic and subsonic nozzles for air guns used for cleaning and other purposes.

2. Background Information

Compressed air guns, also called air blow guns and air jet guns, are used in a variety of work environments, including sonic air guns, subsonic air guns and supersonic air guns. They are often used for cleaning purposes. Unfortunately, misuse of these devices can result in serious injuries.

Compressed air is extremely forceful, with pressures used in the workplace typically ranging from 80 to 120 pounds per square inch (psi), and even higher in certain applications. The primary concern associated with using air at this pressure is the potential to "dead-end" or block the tip of an air gun. If the gun is "dead-ended" against the skin, compressed air can enter the body through small cuts or punctures. Results can range from no damage to soft tissue damage to an embolism (air bubble in the bloodstream). Compressed air can also rupture internal organs if introduced into a body cavity, such as a nostril or ear.

In order to protect users, the static pressure at the tip of a blocked air gun must be limited to less than 30 psi. OSHA developed and issued requirements for the safe use of air guns intended for cleaning in the event of accidental or deliberate use against unprotected human skin. This requirement is that in the event of such a nozzle being placed against unprotected human skin, that the resulting pressure at the air gun exit not exceed 30 psig. Pressures below this level are not considered to represent a health hazard.

One option for meeting the safety requirement is to limit the line pressure flowing into the gun to less than 30 psi, but this pressure level is normally not practical for many applications beyond cleaning. See for example an air gun design having flow pressure reduction in stages, prior to the flow exiting the cleaning nozzle in U.S. Pat. No. 3,814,329.

Another option is the use of a projection of a mechanical structure a safe distance beyond the nozzle exit as seen in U.S. Pat. Nos. 3,888,422, 3,963,180, and 4,036,438, which are incorporated herein by reference. Again this solution limits the applicability of the resulting air gun.

U.S. Pat. No. 4,721,249 discloses an air gun design wherein a single source air supply feeds a plurality of small jets in substantial linear array. This design is also not practical for many air gun applications.

The other option is to use an air gun with a specially designed safety tip. These guns are equipped with relief ports that reduce the pressure at the nozzle to less than 30 psi if blockage occurs. Use of the safety tips is usually the preferred option since it allows cleaning work to be efficiently completed while also affording the proper level of protection. Representative examples of this solution are shown in U.S. Pat. Nos. 3,599,876, 3,647,142, 3,672,575, 3,743,186, 3,774, 847, 3,790,084, 3,790,085, 4,025,045, 4,026,474, 4,243,178, and 5,285,965 which are incorporated herein by reference.

Each of the prior art air gun nozzle devices illustrating the relief port solution has the defect that during normal functional operation, the existence of a parallel open path(s) to the normal forward exiting jet stream simultaneously permits a mechanism for drawing nearby atmospheric air into the working stream that is induced by the lowering of the local pressure of the jet stream, as described by the Bernoulli equation. This joining of air flows thereby reduces the working velocity of the main stream flow, and thus diminishing it's effectiveness. When an air gun is intended to be used for cleaning purposes, this effect may not be readily apparent, but it exists. The resulting reduced air flow velocity reduces the cleaning effect for the gun which may fail to remove those objectionable materials that are more resolutely attached to the local surface to be cleaned.

This defect in the relief port safety tips of the prior art becomes increasingly significant as the working fluid stream is increased in velocity. This reaches a maximum for supersonic air nozzles used for digging in dirt and similar media. These air gun nozzles, whose velocities range usually from MACH 1 (sonic) to about MACH 2 in current applications, have this effect magnified. This is because the local pressure reduction induced by the local high velocity, increases by the square of the velocity increase as explained by the Bernoulli principle.

There remains a need in the industry to provide a fluid nozzle that contains the safety bypass features required for safe operation of air guns and the like, wherein the safety bypass features do not significantly degrade the conventional operation of the device. There is a further need in the art to increase the life of selected air gun components in harsh working environments. There is a further need to address the deficiencies of the prior art in a cost effective manner.

SUMMARY OF THE INVENTION

At least some of the above objects are achieved with a fluid nozzle in accordance with the present invention. The present invention provides a fluid nozzle including a nozzle entrance configured to receive fluid under pressure therein, a fluid conduit through the nozzle extending from the nozzle entrance, a final nozzle exit at an end of the fluid conduit and configured to produce an exit fluid stream which may be adapted to some useful purpose, at least one safety flow passage extending to the fluid conduit and providing for selective redirecting of the exit fluid stream away from the final nozzle exit flow path, when the final nozzle exit is at least substantially obstructed, and least one check valve coupled to each safety flow passage configured to permit such redirected fluid stream to exit the nozzle when the final nozzle exit is at least substantially obstructed, and configured to prevent back flow of local ambient fluid from being drawn through the associated safety flow passage towards the fluid conduit.

The present invention begins similarly to the most common approach represented in the above described references by providing a parallel series of radial safety flow passages to the normal working jet. However, instead of leaving these passages open to the induction of local atmospheric air joining, and thus significantly degrading the main working jet, these parallel paths are blocked by an effective check valve, in various forms.

One non-limiting embodiment of this check valve is an o-ring, lightly installed in a circumferential groove that receives the exit openings or outlets of all of the parallel safety flow passages. This prevents local atmospheric air from entering the working jet under normal operating conditions.

In it's safety function, the o-ring acts as an open check valve, since the pressure trapped by blockage of the normal exit flow, is higher than atmospheric pressure, potentially as high as the 30 psig safety limit, and easily blows the o-ring aside because of it's light assembly pressure over the exits of the parallel passages. And, since the o-ring is in a groove with tapered sides, the o-ring stays in the groove so as to be reseated when the blockage is removed.

Further, as e the escaping air travels in a substantially radial path when leaving the outer circumference of the nozzle, it also serves the function of providing a temporary safety shield for the operator when it is particularly useful, namely when the nozzle exit is partially or completely blocked. This same safety shield is an inherent feature of a few of the above referenced patents, but as they continuously supply this shielding air screen, even during normal function, this will diminish the energy of the working function.

Using an o-ring as a functioning check valve is not the only possible apparatus form. It can also take the form of a thin, cylindrical compliant elastomer, similar to a flat rubber band. In this case, the flat band rests, lightly in a circumferential groove, covering all of the exits of the parallel, diversion passages. It prevents influx of local atmospheric air during normal operation and facilitates exit flow during blockage of the normal working jet.

A third structure is in the form of a flat gasket, extending radially, and clamped axially between a safety tip containing the diverting passages and the body of the nozzle. In this case, the diverting passages extend rearward, axially, and connect the plenum formed in part by the jet blocking obstruction and the sides of the safety tip, to the underside of the flat gasket. As before, the flat gasket acts in the same manner as the o-ring. other forms of lightly biased check valves could also be used, including, but not limited to, a ball and spring, flat springs, etc.

Furthermore the first two of the structure forms, can be constructed within a removable wear tip or contained integrally within the nozzle body. The flat gasket can be best constructed within a removable wear tip. In the case of a supersonic jet, this wear tip structure is used to protect the nozzle exit from damage from the nozzle being thrust into the soil/stones, etc. being excavated. It also serves the purpose of being a wear material for the general protection of the exterior nozzle exit from sand and like hard particles that would otherwise erode the nozzle exterior as it is "sand blasted" by the reversal of material from the ground being jetted.

One non-limiting embodiment of the present invention addresses the above stated object by providing an air gun safety nozzle comprising: a nozzle body and a wear tip coupled to the nozzle body. A nozzle entrance is formed in the nozzle body and configured to receive air under pressure therein, a fluid conduit is provided through the nozzle body and the wear tip axially extending from the nozzle entrance, and a final nozzle exit is in the wear tip at an end of the fluid conduit and configured to produce an exit air stream which may be adapted to some useful purpose. A plurality of safety flow passages extend to the fluid conduit and providing for selective redirecting of the exit air stream away from the final nozzle exit flow path, when the final nozzle exit is at least substantially obstructed; and a check valve is formed of a compliant member coupled to each safety flow passage configured to permit such redirected air stream to exit the nozzle when the final nozzle exit is at least substantially obstructed, and configured to prevent back flow of local ambient fluid from being drawn through the associated safety flow passage towards the fluid conduit.

The advantages of the present invention will be clarified in the description of the preferred embodiments taken together with the attached figures in which like reference numerals represent like elements throughout.

BRIEF DESCRIPTION OF THE DRAWINGS

Other objects and advantages appear in the following description and claims. The enclosed drawings illustrate some practical embodiments of the present invention, without intending to limit the scope of the invention or the included claims.

DETAILED DESCRIPTION OF THE PREFERRED EMBODIMENTS

Figures 1A, 1B, 1C, 1D:
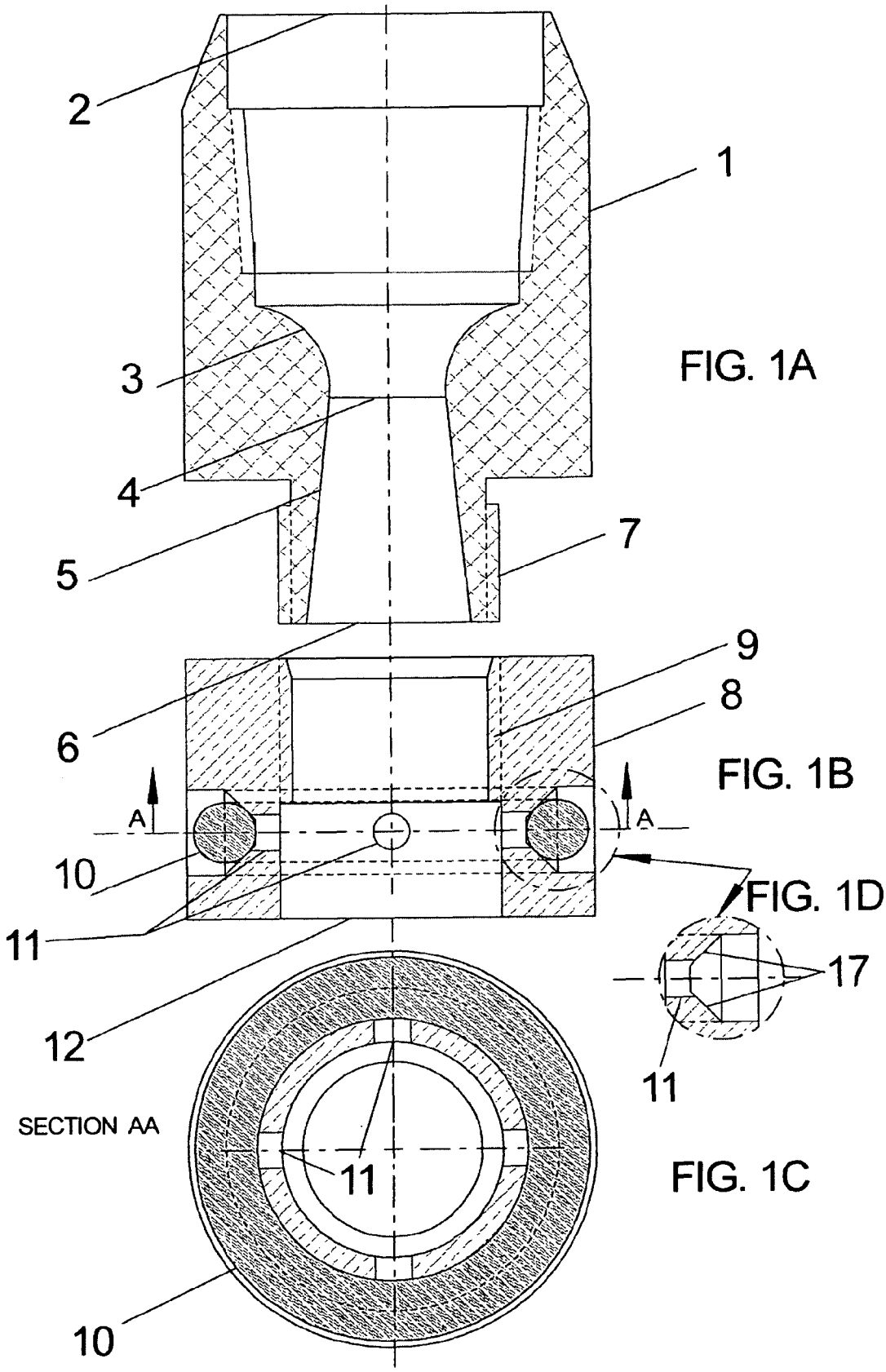
FIG. 1A is a section view of a nozzle body for an air gun safety nozzle in accordance with a first embodiment of the present invention.
FIG. 1B is a section view of a wear tip for an air gun safety nozzle in accordance with a first embodiment of the present invention.
FIG. 1C is a section view of the wear tip of FIG. 1B taken along section line A-A of FIG. 1B.
FIG. 1D is an enlarged section view of an safety passage outlet exit and o-ring seating groove, with the o-ring removed, of the wear tip of FIG. 1B.
Figure 2A:
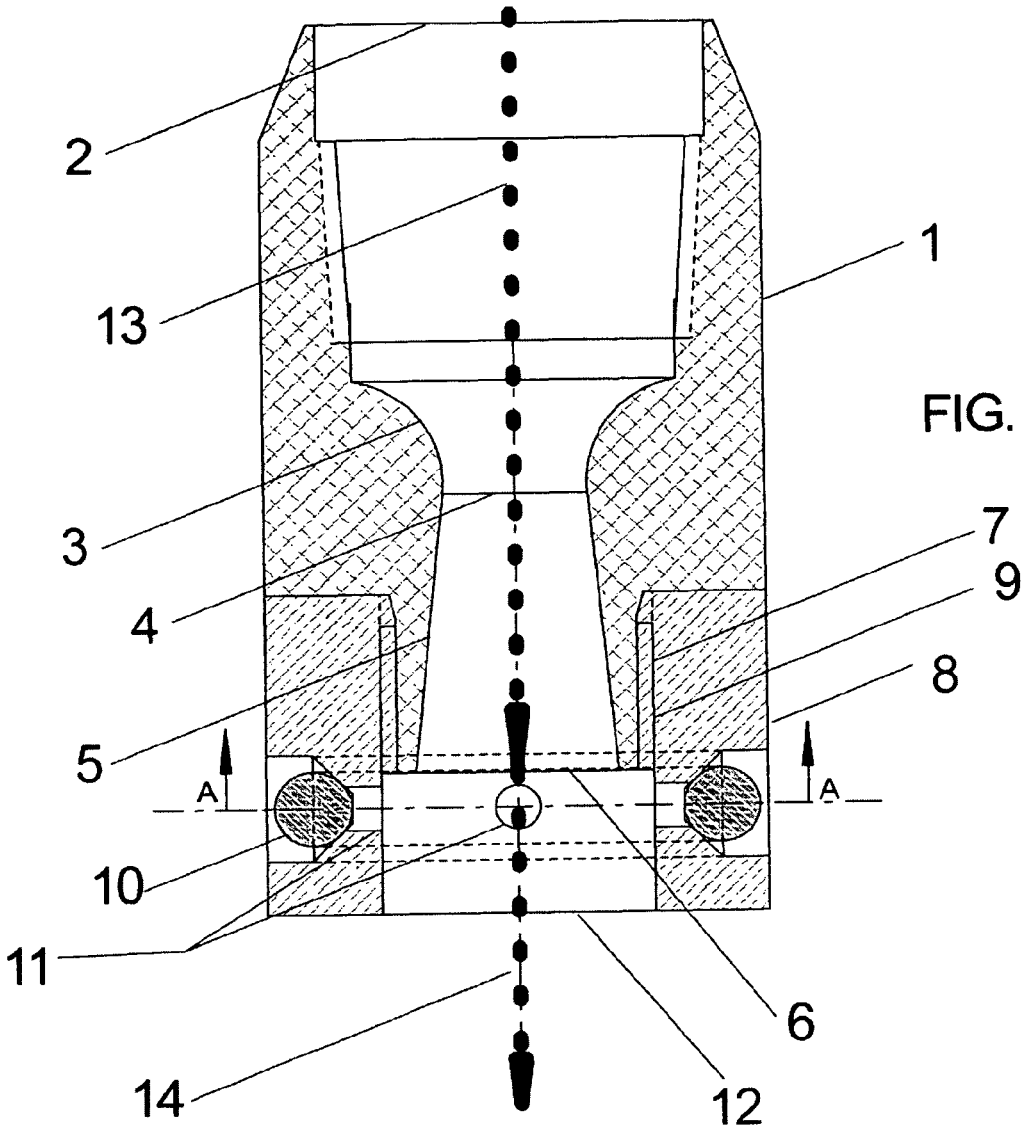
FIG. 2A is a section view of the air gun safety nozzle of FIGS. 1A-1D, showing the wear tip of FIG. 1B threaded onto the nozzle body of FIG. 1A, and further schematically illustrating the normal jet air path in operation.
Figure 2B:
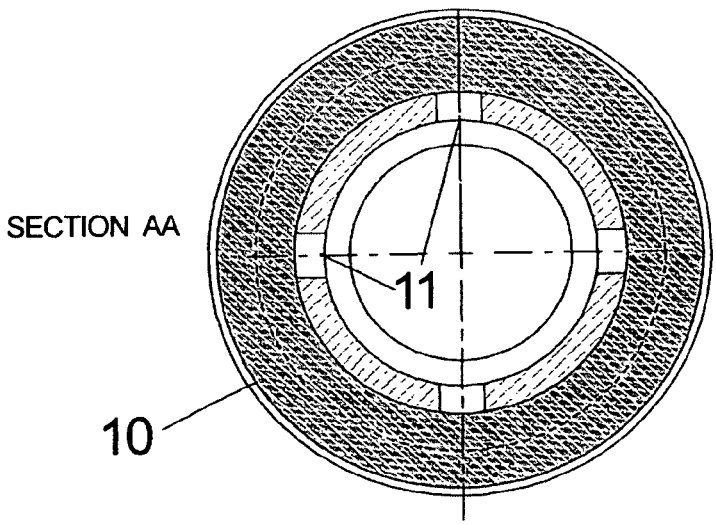
FIG. 2B is a section view of the safety nozzle of FIG. 2A taken along section line A-A of FIG. 2A.
Figure 3A:
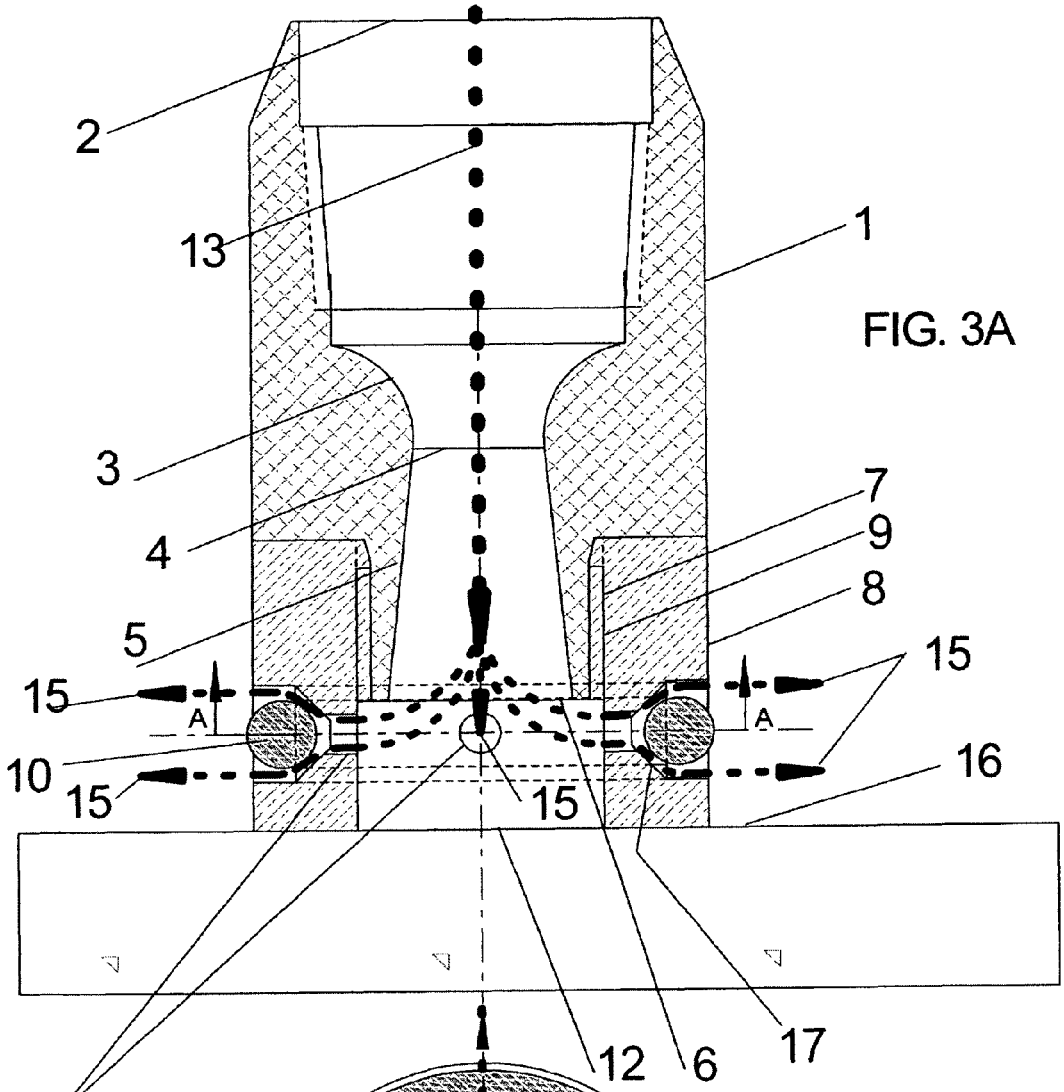
FIG. 3A is a section view of the air gun safety nozzle of FIG. 2A and schematically illustrating the diverted air path, when the normal air path is substantially or completely blocked.
Figure 3B:
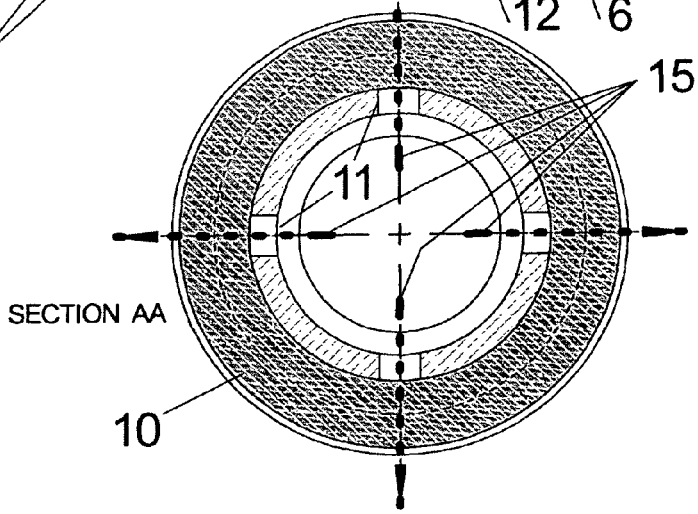
FIG. 3B is a section view of the safety nozzle of FIG. 3A taken along section line A-A of FIG. 3A.
Figures 4A, 4B, 4C:
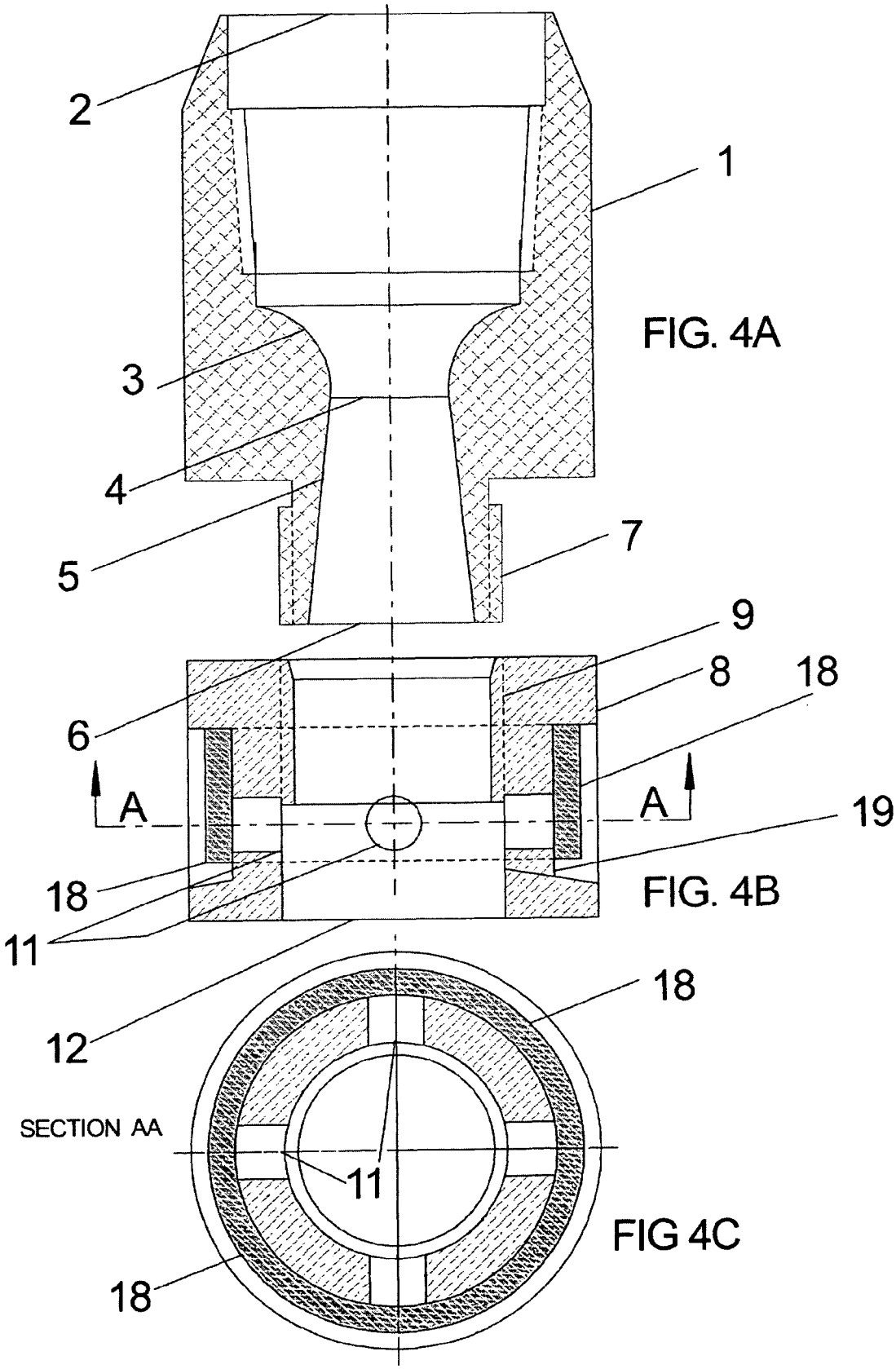
FIG. 4A is a section view of a nozzle body for an air gun safety nozzle in accordance with an alternative embodiment of the present invention.
FIG. 4B is a section view of a wear tip for an air gun safety nozzle in accordance with an alternative embodiment of the present invention.
FIG. 4C is a section view of the wear tip of FIG. 4B taken along section line A-A of FIG. 4B.

As will be described in greater detail below the present invention provides an air gun safety nozzle having a nozzle body 1 and an associated wear tip 8 coupled to the nozzle body 1. A nozzle entrance 2 is formed in the nozzle body 1 and configured to receive air under pressure therein in a known fashion. A fluid conduit is provided through both the nozzle body 1 and the wear tip 8 and is axially extending from the nozzle entrance 2. The fluid conduit will include the converging section 3, the throat 4 and diverging section 5 in the nozzle body 1. A final nozzle exit 12 is provided in the wear tip 8 at an end of the fluid conduit and configured to produce an exit air stream 14 which may be adapted to some useful purpose. The present invention provides a plurality of safety flow passages 11 extending to the fluid conduit and providing for selective redirecting of the exit air stream away from the final nozzle exit 12 flow path, when the final nozzle exit 12 is at least substantially obstructed. A check valve formed of a compliant member, such as o-ring 10 or band 18, coupled to each safety flow passage 11 configured to permit such redirected air stream to exit the nozzle when the final nozzle exit 12 is at least substantially obstructed, and configured to prevent back flow of local ambient fluid from being drawn through the associated safety flow passage 11 towards the fluid conduit.

FIGS. 1A-3B illustrate one non-limiting embodiment of the present invention. The nozzle body 1, shown as a supersonic nozzle, has a nozzle thread 7 that engages a safety tip thread 9 of the wear tip 8 (also called a safety tip), so as permit the safety tip or wear tip 8 to be removable. The safety wear tip 8 provides an effective extension of the nozzle body 1, beyond the nozzle exit 6. This extension, for a supersonic nozzle, provides external erosion resistance and general damage protection for the nozzle exit 6 from being thrust upon the ground. The wear resistance is required to resist erosion from sand and like, hard particles in the earth that are blasted back upon the nozzle, while digging in the earth.

The nozzle body 1 as shown is of the supersonic air variety, consisting of a nozzle contraction 3, a nozzle throat 4 and a nozzle expansion 5. The nozzle of the present invention is not limited to air but can be used with any fluid, with the term fluid encompassing both fluids and gasses. Air nozzles do allow for particular applications where other fluids would be inappropriate. Additionally in operation the fluid may contain particulates therein for certain applications. However, with liquid fluids or fluids containing particulates the nozzle body 1 would experience much more significant wearing during operation. The use of air, or similar compressed gas, does not cause any substantive wear on the fluid passage such as the nozzle contraction 3, the nozzle throat 4 and the nozzle expansion 5. The nozzle body 1 and the safety or wear tip 8 can be formed of any conventional material, generally a metal such as steel, aluminum or brass that is readily available and easily machined. The entrance 2 is coupled to a source of pressurized fluid (e.g. compressed air) in a conventional fashion. As illustrated in the figures the nozzle body 1 may include threads upstream of the converging portion 3. Any attachment can be used.

Safety flow passages 11 in the safety or wear tip 8 provide alternative flow paths, when the nozzle final exit 12 air flow 14 is blocked, including, potentially by human skin. These alternative flows passages 11 exit towards circumferential, tapered o-ring seats 17 that lightly constrain a compliant member, namely an o-ring 10 against it's seat. The pressure of the o-ring 10 against it's seat is slight, whereby the pressure buildup within the safety tip 8 easily bypasses the o-ring 10, escaping and thereby permitting the internal air pressure within the safety tip 8 to reduce to or below the safe regulatory limit of 30 psig. The O-ring 10 can be selected and designed to achieve any desired safety release pressure, in conjunction with an appropriate total flow area of the alternate flow passages 11.

The nozzle air flow path 13 enters at the nozzle entrance 2 and proceeds toward the nozzle exit 6 under all conditions. When operating normally, the normal exit air flow 14 occurs. When the nozzle is blocked, the safety tip exit air flow 15 occurs, passing each side of the o-ring 10. This exiting air in air flow 15 also serves the purpose of creating an air shield to protect the operator. If a single stronger air shield is desired in stead of the dual shield produced by air bypassing both sides of the o-ring 10, the safety flow entrances can be biased in one axial location towards one axial side of the o-ring 10 so as to induce the bypass flow to go to one side of the o-ring 10.

During normal operation, the air flow takes it's normal path designated by 13 and 14. In this condition, the normal exit flow, being at it's highest velocity, creates it's maximum local pressure drop below atmospheric, (Bernoulli effect) and thus, except for the blocking presence of the o-ring, would induce contaminating air flow between local atmospheric pressure and the lower local air jet pressure via passages 11. The O-ring 10 forms a check valve for each of the openings of the passages 11 and thus maintains the standard operating efficiency of the nozzle.

Figure 5A:
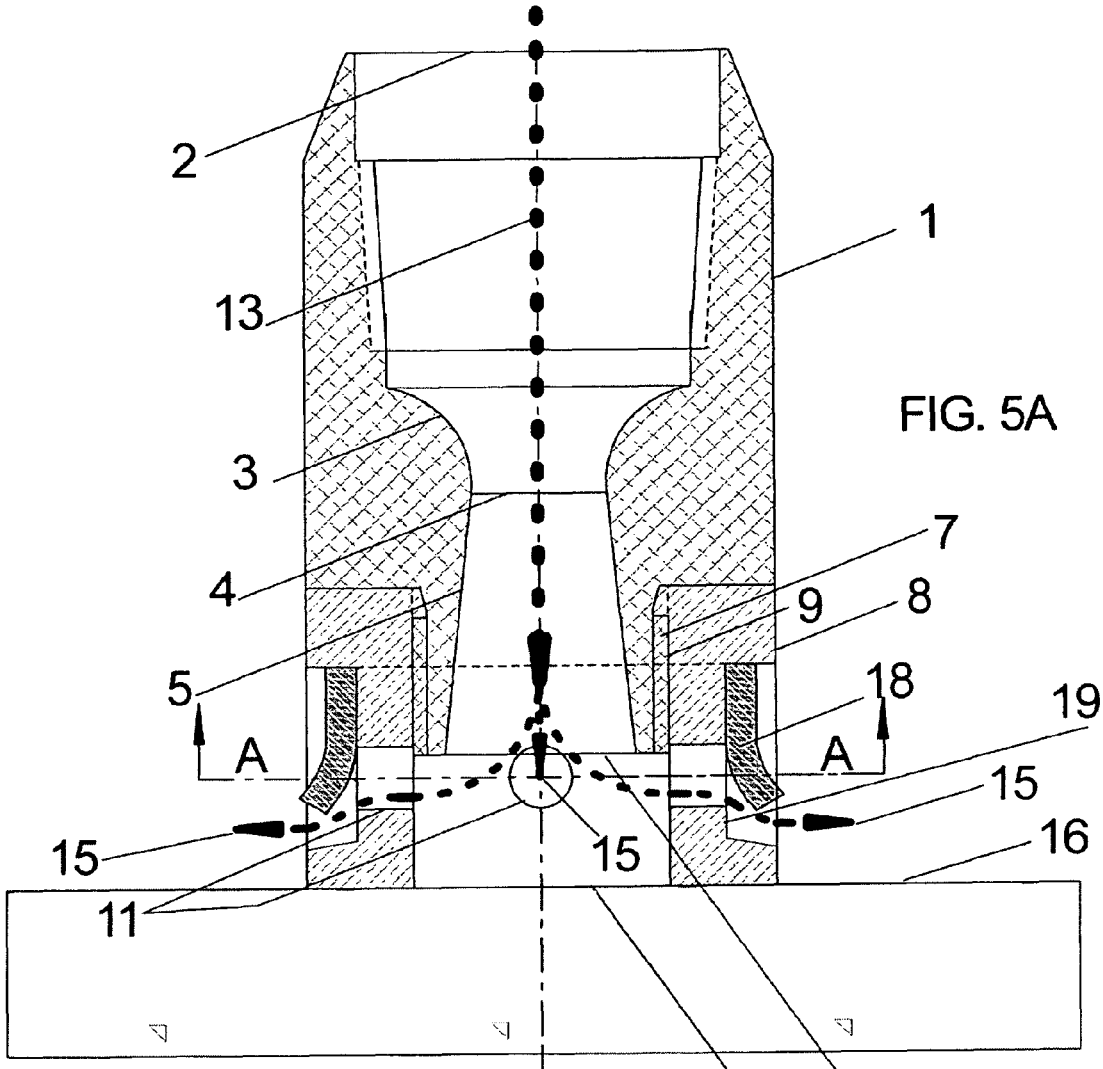
FIG. 5A and FIG. 5B are section views of the air gun safety nozzle of FIGS. 4A-4C, showing the wear tip of FIG. 4B threaded onto the nozzle body of FIG. 4A, and further schematically illustrating the diverted air path, when the normal air path is blocked.
Figure 5B:
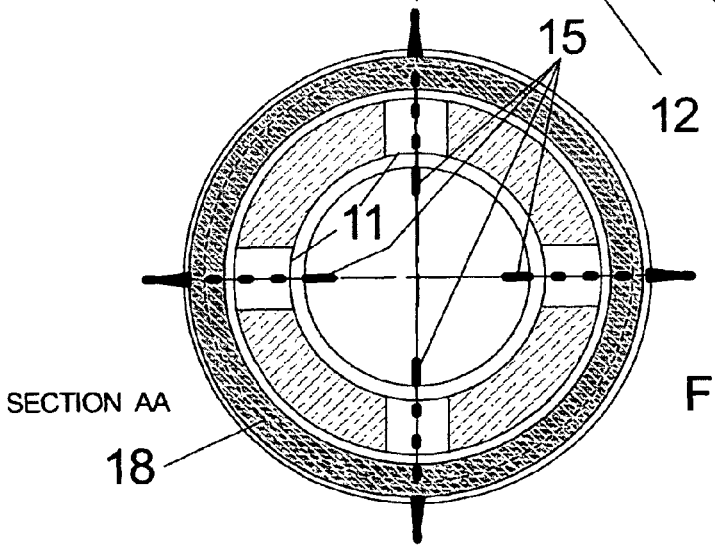
Figures 6A, 6B, 6C, 6D:
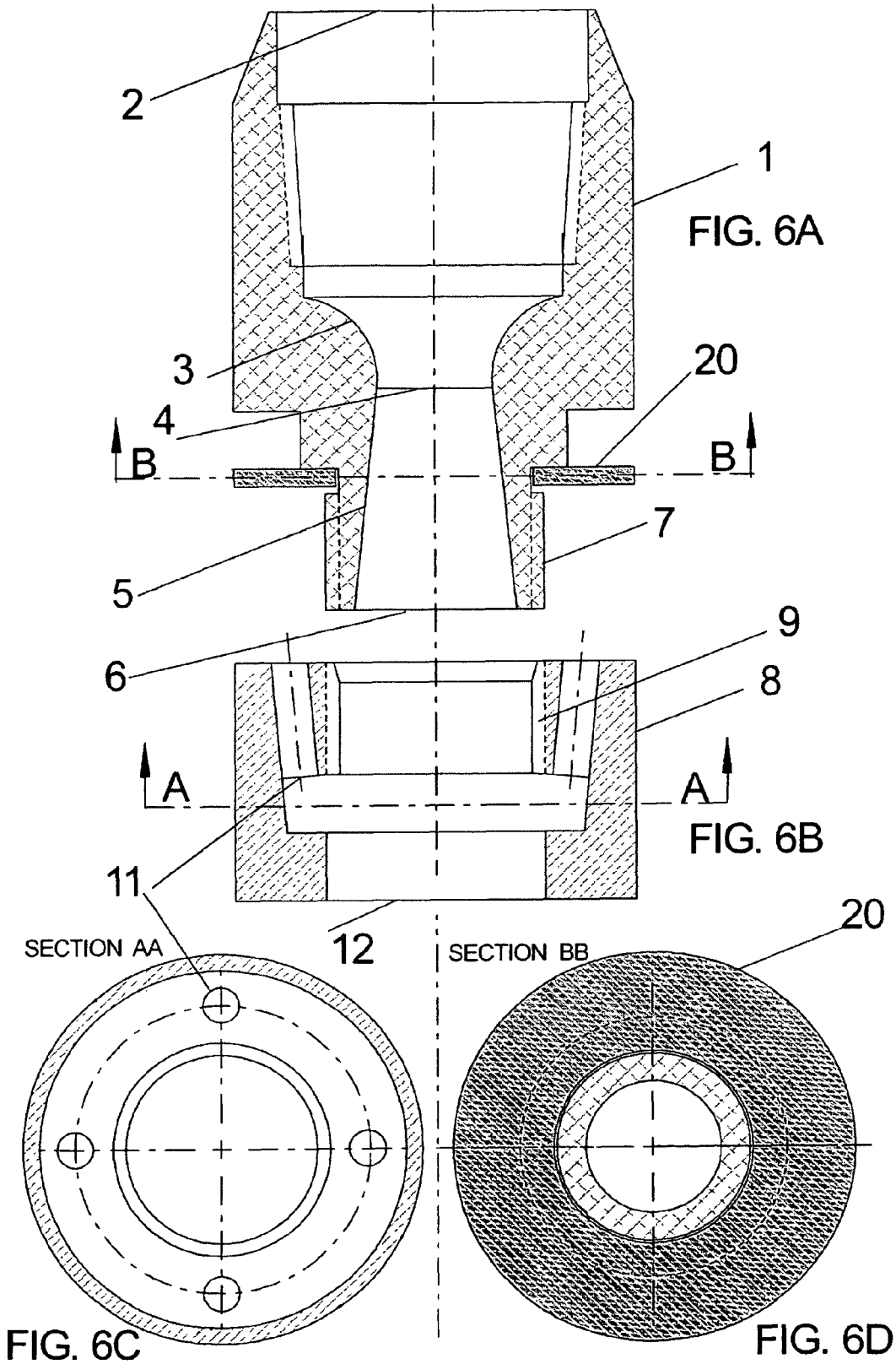
FIG. 6A is a section view of a nozzle body for an air gun safety nozzle in accordance with another alternative embodiment of the invention.
FIG. 6B is a section view of a wear tip for an air gun safety nozzle in accordance with an alternative embodiment of the present invention.
FIG. 6C is a section view of the of the wear tip of FIG. 6B taken along section line A-A of FIG. 6B.
FIG. 6D is a section view of the of the nozzle body of FIG. 6A taken along section line B-B of FIG. 6A.
Figures 7A, 7B, 7C:
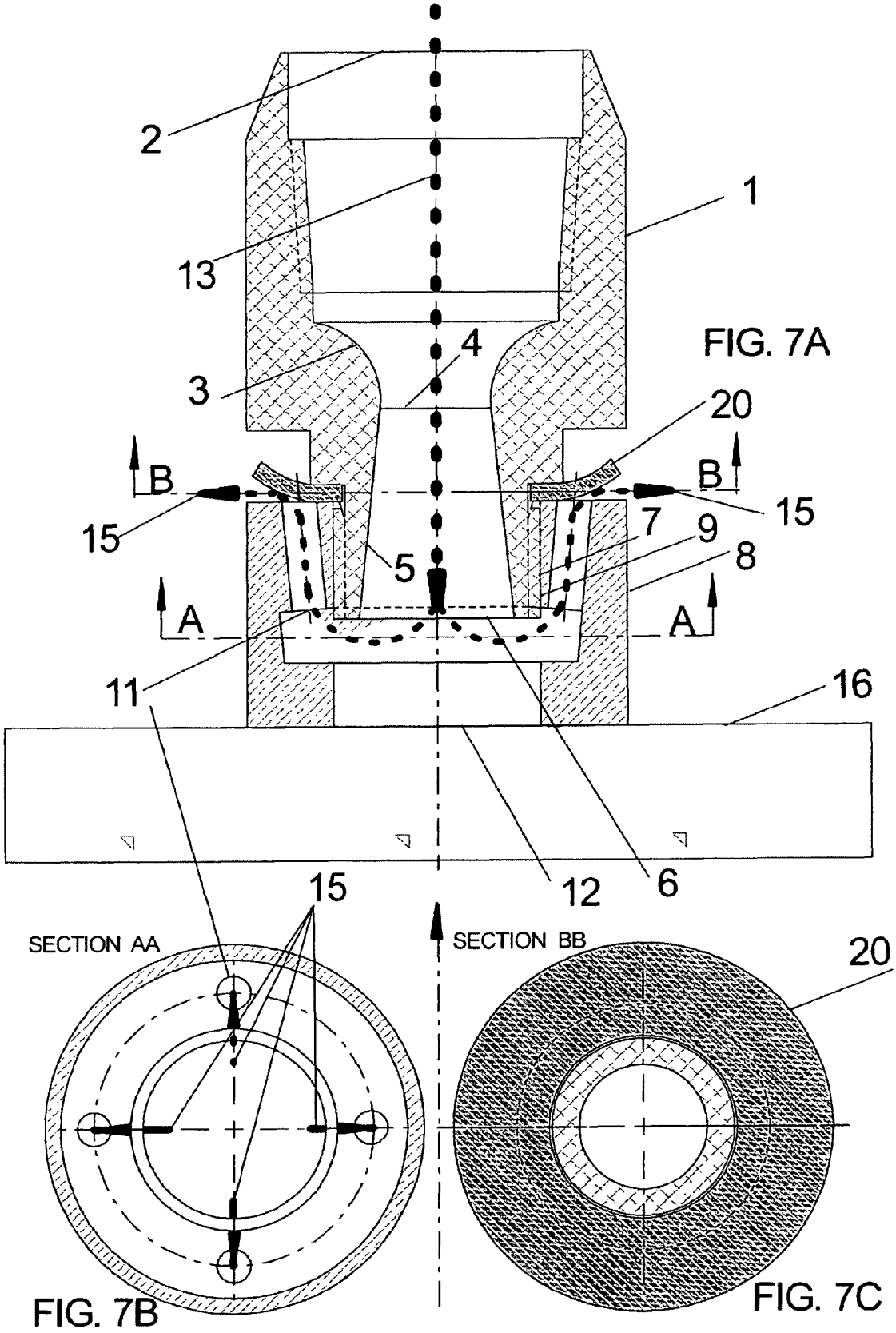
FIG. 7A is a section view of the air gun safety nozzle of FIGS. 6A-6D, showing the wear tip of FIG. 6B threaded onto the nozzle body of FIG. 6A, and further schematically illustrating the diverted air path, when the normal air bath is blocked.
FIG. 7B is a section view of the of the wear tip of FIG. 7A taken along section line A-A of FIG. 7A.
FIG. 7C is a section view of the of the nozzle body of FIG. 7A taken along section line B-B of FIG. 7A.

A similar description applies to another non-limiting embodiment of the invention disclosed in FIGS. 4A-5B. This embodiment operates similarly to that described above in connection with FIGS. 1A-4C. In the embodiment of FIGS. 4A-5B the check valve forming compliant member, identified as o-ring 10 in the earlier embodiment, has been replaced with a thin, elastomer safety ring seal 18, similar to an elastic band, that covers the safety flow passages 11 to prevent local atmospheric flow into the normal jet stream 14. The safety ring seal 18 is rectangular in cross sectional shape, and the rectangular groove 19 is configured to suit. As illustrated in FIGS. 5 and 5B, when the nozzle normal exit flow 14 is blocked, the trapped pressure within the safety tip is released through the safety flow passages 11 so as to reduce the trapped air pressure to or below the regulatory requirement of 30 psig.

A similar description also applies to the embodiment illustrated in FIGS. 6A-7C. In this version, the elastomer band 18 is flat, and clamped between the safety tip 8 and the nozzle 1, with the outer circumferential portion left free to act in a similar manner as the elastomer band 18 in the above embodiment. The safety flow passages 11 are, in this case, axial within the safety tip 8.

It should also be apparent that the first two embodiments can form the wear tip 8 and associated passages 11 as integral with the nozzle body 1. However, the preferred embodiments, particularly when the nozzles are supersonic, is forming these components as a replaceable safety tip 8, because of the potential blow back of hard dirt particles (sand, etc) during digging, which erodes the leading and exterior surface of the nozzle. In this circumstance, there is a need to replace the safety tips 8 periodically. This is not a concern for air tools used for cleaning purposes because the air exit velocity is lower.

Also, in each embodiment of this invention described above, the desirable feature of a radial shield of air to protect the operator from flying debris is also achieved.

Figures 8A, 8B, 8C:
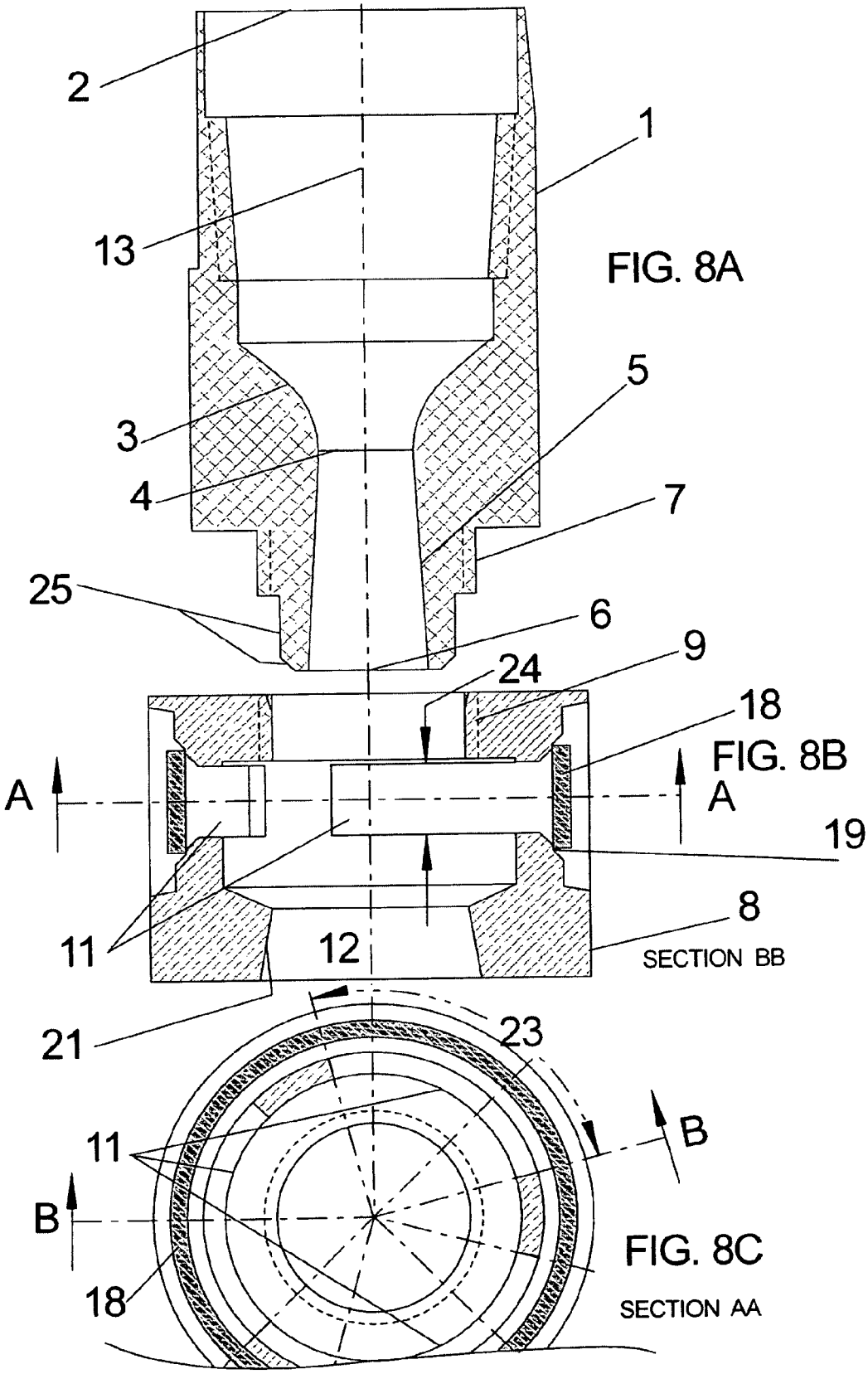
FIG. 8A is a section view of a nozzle body for an air gun safety nozzle in accordance with an alternative embodiment of the present invention.
FIG. 8B is a section view of a wear tip for an air gun safety nozzle in accordance with an alternative embodiment of the present invention taken along section B-B of FIG. 8C, including circumferentially elongated exit slots 23 of dimensional width 24.
FIG. 8C is a section view of the wear tip of FIG. 8B taken along the section line A-A illustrating the circumferentially elongated slots 23.
Figure 9A:
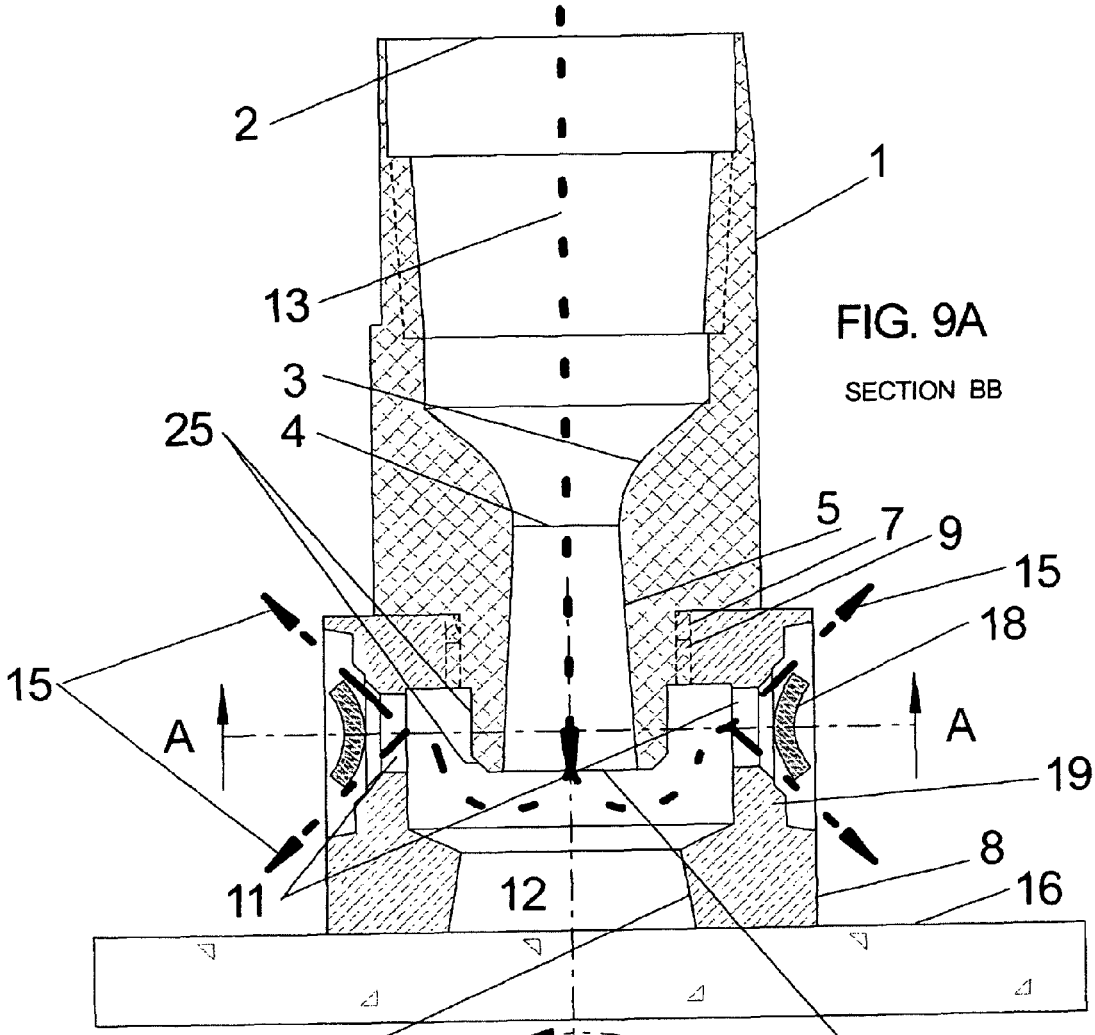
FIG. 9A is a section view of the air gun safety nozzle of FIGS. 8A-8C, showing the wear tip of FIG. 8B treaded onto the nozzle body of FIG. 8A, and further schematically illustrating the diverted air path, when the normal air path is blocked.
Figure 9B:
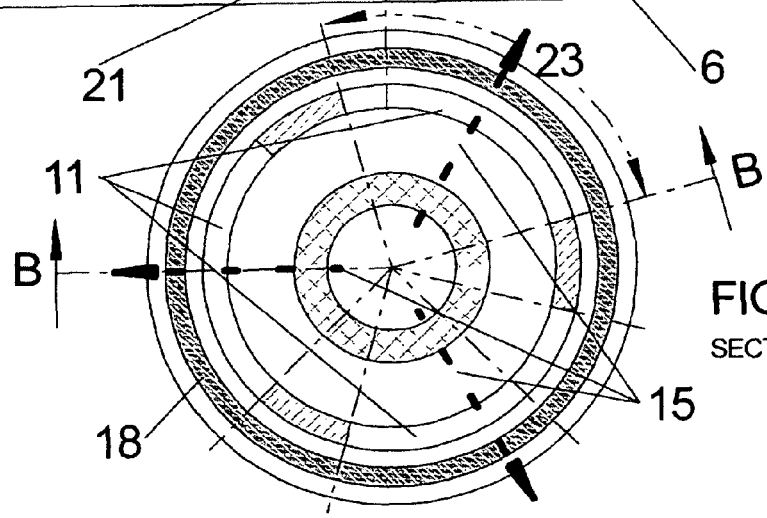
FIG. 9B is a section view of FIG. 9A, taken along section line A-A of FIG. 9A that illustrates the large open area and other characteristics of the diverted flow path.

For nozzles designed for a higher range of mass flow rate, including supersonic, sonic and subsonic designs, significantly larger flow area will be required for the diverted flow. This is especially true of sonic and supersonic designs, because of their usually compact nozzle designs. FIGS. 8A-8C and FIGS. 9A-9B illustrate such a variation. In particular, the wear tip 8 of FIG. 8B shows a circumferentially long slot (angle 23) which is also axially wide (dimension 24) to provide such larger area. Similarly, in FIG. 8A, the exterior of the nozzle has been reduced in diameter (25) and contoured about its exit so as to enhance the available flow area as the diverted flow passes around the exterior of the nozzle exit and towards the much larger slot in the wear tip 8. This can best be seen in FIG. 9A, but also in FIG. 8A.

The present invention has been described with reference to specific details of particular embodiments thereof. It is not intended that such details be regarded as limitations upon the scope of the invention. It will be apparent that various modifications can be made without departing from the spirit and scope of the present invention. The precise scope of the invention is to be defined by the appended claims and equivalents thereto.

What is claimed is:

1. A fluid nozzle comprising:

A nozzle entrance configured to receive fluid under pressure therein;

A fluid conduit through the nozzle extending from the nozzle entrance;

A final nozzle exit at an end of the fluid conduit and configured to produce an exit fluid stream which may be adapted to some useful purpose;

at least one safety flow passage extending to the fluid conduit and providing for selective redirecting of the exit fluid stream away from the final nozzle exit flow path, when the final nozzle exit is at least substantially obstructed; and at least one check valve coupled to each safety flow passage configured to permit such redirected fluid stream to exit the nozzle when the final nozzle exit is at least substantially obstructed, and configured to permit an exit fluid stream through the final nozzle exit at least when the final nozzle exit is not substantially obstructed whereby the check valve is configured to prevent back flow of local ambient fluid from being drawn through the associated safety flow passage towards the fluid conduit.

2. The fluid nozzle of claim 1, wherein at least one check valve is a compliant member in the form of an o-ring, resting in a groove that receives at least one exit of a safety flow passage.

3. The fluid nozzle of claim 1, wherein at least one check valve is a compliant member in the shape of an axially disposed ring, resting in a groove that receives at least one the exit of a safety flow passage.

4. The fluid nozzle of claim 1, wherein at least one check valve is a compliant member in the shape of a flat gasket or ring which is rectangular in cross section and which is resting against at least one exit of a safety flow passage.

5. The fluid nozzle of claim 1, wherein each check valve is associated with at least two opposed safety flow passages and each check valve is formed of one of a flexible band, discrete, spring biased check valves, and circumferentially or axially arrayed cantilever springs.

6. The fluid nozzle of claim 1, further including a replaceable wear tip selectively attachable to a nozzle body, wherein the wear tip includes the final nozzle exit and the nozzle body includes the nozzle entrance.

7. The fluid nozzle of claim 6, wherein each check valve is associated with at least two opposed safety flow passages and each check valve and wherein the safety flow passages are located within the wear tip.

8. The fluid nozzle of claim 1, in which the discharge of redirected fluid through the at least one safety flow passage is directed generally in a radial direction and configured to provide a temporary safety shield to protect the operator.

9. The fluid nozzle of claim 1, wherein each check valve is associated with at least two opposed safety flow passages and each check valve and in which the nozzle is supersonic.

10. A fluid safety nozzle comprising:

A nozzle body;

A wear tip coupled to the nozzle body;

A nozzle entrance formed in the nozzle body and configured to receive fluid under pressure therein;

A fluid conduit through the nozzle body and the wear tip axially extending from the nozzle entrance;

A final nozzle exit in the wear tip at an end of the fluid conduit and configured to produce an exit fluid stream which may be adapted to some useful purpose;

A plurality of safety flow passages extending to the fluid conduit and providing for selective redirecting of the exit fluid stream away from the final nozzle exit flow path, when the final nozzle exit is at least substantially obstructed; and A check valve coupled to each safety flow passage configured to permit such redirected fluid stream to exit the nozzle when the final nozzle exit is at least substantially obstructed, and configured to permit an exit fluid stream through the final nozzle exit at least when the final nozzle exit is not substantially obstructed whereby the check valve is configured to prevent back flow of local ambient fluid from being drawn through the associated safety flow passage towards the fluid conduit.

11. The fluid safety nozzle of claim 10, wherein at least one check valve is a compliant member in the form of an o-ring, resting in a groove that receives exit openings of a plurality of safety flow passages.

12. The fluid safety nozzle of claim 10, wherein at least one check valve is a compliant member in the shape of an axially disposed ring, resting in a groove that receives exit openings of a plurality of safety flow passages.

13. The fluid safety nozzle of claim 10, wherein at least one check valve is a compliant member in the shape of a flat gasket or ring which is rectangular in cross section and which is resting against exit openings of a plurality of safety flow passages.

14. The fluid safety nozzle of claim 10, wherein each check valve is associated with at least two opposed safety flow passages and each check valve is formed of one of a flexible band, discrete, spring biased check valves, and circumferentially or axially arrayed cantilever springs.

15. The fluid safety nozzle of claim 10, wherein each check valve is associated with at least two opposed safety flow passages and the safety flow passages are located within the wear tip.

16. The fluid safety nozzle of claim 10, in which the discharge of redirected fluid through at least one safety flow passage is directed generally in a radial direction and configured to provide a temporary safety shield to protect the operator.

17. The fluid safety nozzle of claim 10, wherein each check valve is associated with at least two opposed safety flow passages and in which the nozzle is supersonic.

18. An air gun safety nozzle comprising:

A nozzle body;

A wear tip coupled to the nozzle body;

A nozzle entrance formed in the nozzle body and configured to receive air under pressure therein;

A fluid conduit through the nozzle body and the wear tip axially extending from the nozzle entrance;

A final nozzle exit in the wear tip at an end of the fluid conduit and configured to produce an exit air stream which may be adapted to some useful purpose;

A plurality of safety flow passages extending to the fluid conduit and providing for selective redirecting of the exit air stream away from the final nozzle exit flow path, when the final nozzle exit is at least substantially obstructed; and A check valve formed of a compliant member coupled to each safety flow passage configured to permit such redirected air stream to exit the nozzle when the final nozzle exit is at least substantially obstructed, and configured to permit an exit fluid stream through the final nozzle exit at least when the final nozzle exit is not substantially obstructed whereby the check valve is configured to prevent back flow of local ambient fluid from being drawn through the associated safety flow passage towards the fluid conduit.

19. The air gun safety nozzle of claim 18, wherein each check valve is associated with at least two opposed safety flow passages and in which the nozzle is supersonic.

20. The air gun safety nozzle of claim 18, wherein each check valve is associated with at least two opposed safety flow passages and the safety flow passages are located within the wear tip.

* * * * *